US005347803A

United States Patent [19]

Stahlecker et al.

[11] Patent Number: 5,347,803

[45] Date of Patent: Sep. 20, 1994

[54] SPINNING MACHINE AND A PROCESS FOR CHANGING BLOCKS OF SLIVER CANS ON A SPINNING MACHINE

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[21] Appl. No.: 871,314

[22] Filed: Apr. 20, 1992

[30] Foreign Application Priority Data

Apr. 24, 1991 [DE] Fed. Rep. of Germany ..... 4113296

[51] Int. Cl.[5] ..... D01H 13/02

[52] U.S. Cl. ..... 57/90

[58] Field of Search ..... 57/90, 281, 91, 261, 57/263, 264, 276; 19/159 A, 157, 243; 414/572, 573, 574, 344, 395

[56] References Cited

U.S. PATENT DOCUMENTS

| | | | |
|---|---|---|---|
| 3,564,829 | 2/1971 | Tsuzuki | 57/90 |
| 4,078,369 | 3/1978 | Brandis | 57/90 |
| 4,150,534 | 4/1979 | Raasch | 19/159 A |
| 4,577,372 | 3/1986 | Roder | 19/159 A |
| 4,642,851 | 2/1987 | Hera | 19/159 A |
| 4,972,699 | 11/1990 | Raasch | 19/159 A |
| 5,081,744 | 1/1992 | Siegenthaler | 19/159 A |

FOREIGN PATENT DOCUMENTS

| | | |
|---|---|---|
| 817572 | 10/1951 | Fed. Rep. of Germany . |
| 2526702 | 6/1975 | Fed. Rep. of Germany . |
| 3728929 | 8/1987 | Fed. Rep. of Germany . |

*Primary Examiner*—Clifford D. Crowder
*Assistant Examiner*—Larry D. Worrell, Jr.
*Attorney, Agent, or Firm*—Evenson, McKeown, Edwards & Lenahan

[57] ABSTRACT

In a process for exchanging blocks of cans on a spinning machine, it is provided that the exchanging of the cans is carried out when the spinning operation is interrupted. During or after the removal of all cans spun empty, the depositing sites, row by row, are supplied with full cans. Subsequently, the spinning stations belonging to these depositing sites are prepared, row by row, for the withdrawal of the slivers from these supplied cans, in which case maximally two rows of depositing sites are charged and the pertaining spinning stations are prepared before the next maximally two rows of depositing sites are charged.

16 Claims, 11 Drawing Sheets

SPINNING MACHINE AND A PROCESS FOR CHANGING BLOCKS OF SLIVER CANS ON A SPINNING MACHINE

BACKGROUND AND SUMMARY OF THE INVENTION

The invention relates to a spinning machine and a process for changing blocks of cans on a spinning machine of the type which is provided with a plurality of spinning stations to each of which a depositing site is assigned for a can containing a sliver to be spun. The depositing sites are arranged in several rows extending in the longitudinal direction of the machine. The cans which are spun empty are transported away from the depositing sites, full cans are guided to the depositing sites, and the spinning stations are prepared for the withdrawal of the slivers of the full cans.

In the case of a known process of the initially mentioned type (German Patent Document DE-A 37 28 929), two rows of depositing sites for cans, which extend in the longitudinal direction of the machine, are assigned to each side of the machine. The depositing sites of the respective outer cans are formed by a conveyor belt extending in the longitudinal direction of the machine. The filling ratio of the cans of one row is identical in each case. However, the filling ratio of the cans of the outer row, in each case, is less than the filling ratio of the inner row. Another conveyor belt extends in the machine center from which a spare row of cans is supplied. As soon as the cans of one of the outer rows of cans have been spun empty, these cans are transported away in the longitudinal direction of the machine. Subsequently, the inner row of this side of the machine is then taken to the outside onto the conveyor belt so that this row now becomes the outer row. The cans of the spare row are then placed on the depositing sites of the inner row which have become vacant. In order to continue the spinning, the spinning stations to which the full cans are assigned must then be prepared, for which the starting piece of the slivers of the full cans must be applied to corresponding withdrawal devices. For this purpose, an operating aisle for the operators is left in the center of the machine.

A double-sided ring-spinning machine is also known (German Patent Document 817 572) to which the sliver to be spun is supplied in cans. Each can contains at least four slivers; that is, each can is assigned to at least four spinning stations. The cans are deposited in two rows on a conveyor belt arranged in an elevated manner in the center of the machine. By means of the conveyor belt, the cans which were spun empty can be moved out beyond the front face of the machine.

It is also known (German Patent Document DE-A 25 26 702) to provide, in the case of a two-sided open-end spinning machine, two rows of depositing sites for cans on each side of the machine. Also in the case of this construction, the cans are changed in blocks for each side of the machine. The transport of the cans takes place by means of transport carriages which are assembled into a train. This train travels past a flyer frame in a timed manner, the empty cans being unloaded from the transport carriage and full cans being loaded onto it. After having been fully loaded, the train travels to the open-end spinning machine at which the delivery of the full cans will then take place.

It is an object of the invention to develop a process of the initially mentioned type such that the changing operation as a whole is carried out with a time consumption that is as low as possible and as efficiently as possible, in which case the operator or the automatic device must cover paths that are as short as possible, and in which case this process can also be used when the depositing sites are provided in more than two rows for each side of the machine.

This object is achieved according to preferred embodiments of the invention in that the exchanging of the cans is carried out when the spinning process is interrupted, in that, after the moving-away of all cans, the depositing sites row by row are supplied with full cans, and the spinning stations pertaining to the depositing sites which are first supplied in one or two rows, are prepared in rows for the withdrawal of the slivers from these supplied cans, in which case the next supplying of the full cans is carried out in rows and the next preparing of the pertaining spinning stations is carried out in rows.

By means of this process, the exchange of cans is carried out in such a manner that, particularly during the preparation of the spinning stations for the withdrawal of the slivers from the full cans, no unnecessary paths must be covered so that unproductive path-covering times are eliminated almost completely. The full cans, which are supplied to the depositing sites in respective rows then permit a preparation of the spinning stations in rows. In this case, it is possible that an operator or an automatic device, will be capable, from the direction of one location, of also preparing the spinning stations after two rows of cans have already been supplied; that is, to service two cans standing behind one another in such a manner that the starting pieces of the sliver can be taken out there and can be fed to the spinning station.

In a further development of the invention, a spinning machine is provided where the depositing sites are in each case a component of the transport devices extending in the longitudinal direction of the machine to which, at one end face, devices are assigned for the feeding of full cans and, at the other end face of the spinning machine, devices are assigned for the moving-away of cans which were spun empty.

By means of such a spinning machine, the process according to the invention can be carried out in an advantageous manner.

Other objects, advantages and novel features of the present invention will become apparent from the following detailed description of the invention when considered in conjunction with the accompanying drawings.

DETAILED DESCRIPTION OF THE DRAWINGS

Figure 1:
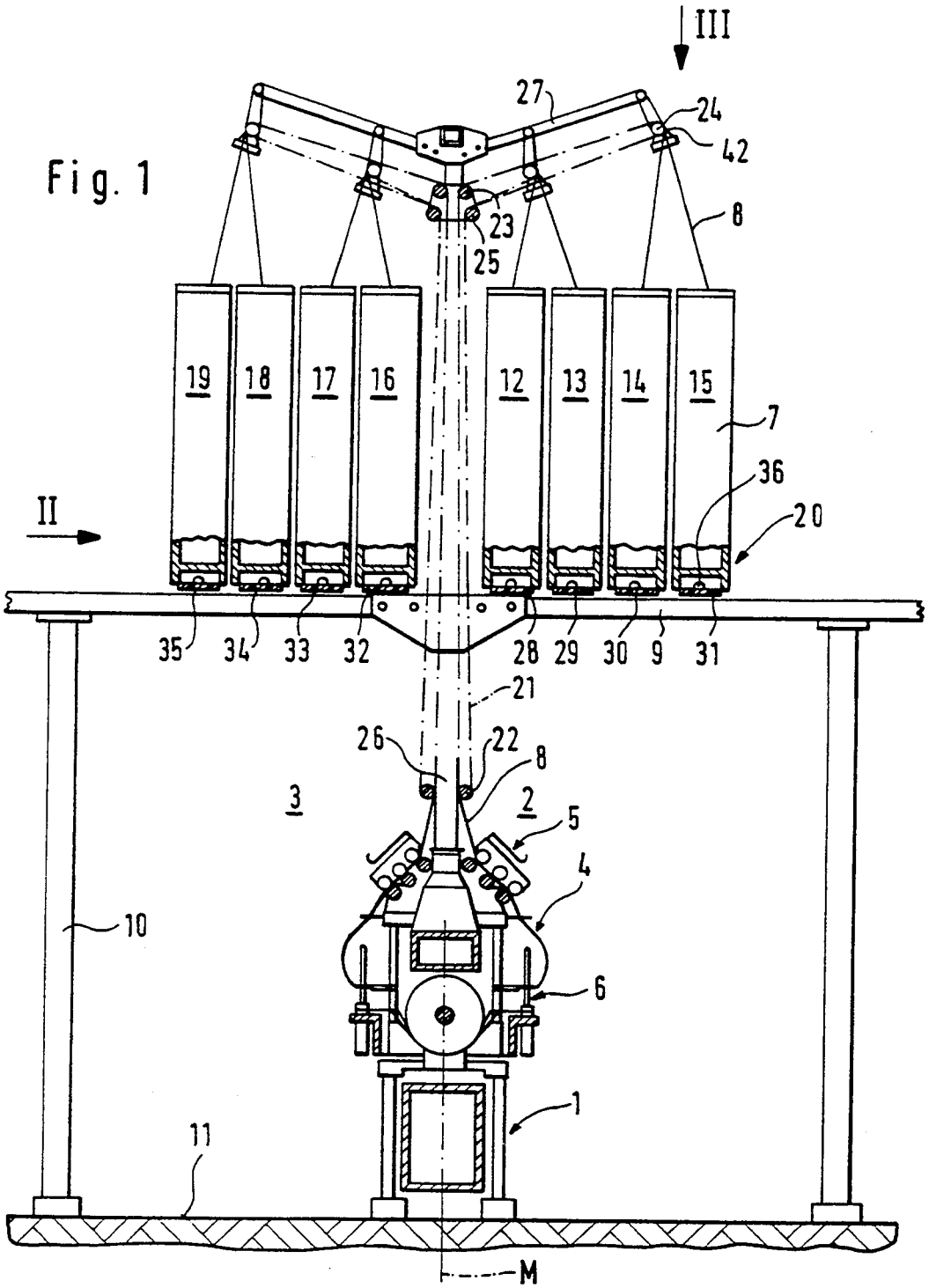
FIG. 1 is a schematic partially sectional front view of a machine system with a two-sided ring spinning machine, to the spinning stations of which one sliver respectively is fed in cans which are deposited in several rows on a platform above the spinning machine, constructed according to a preferred embodiment of the invention.
Figure 2:
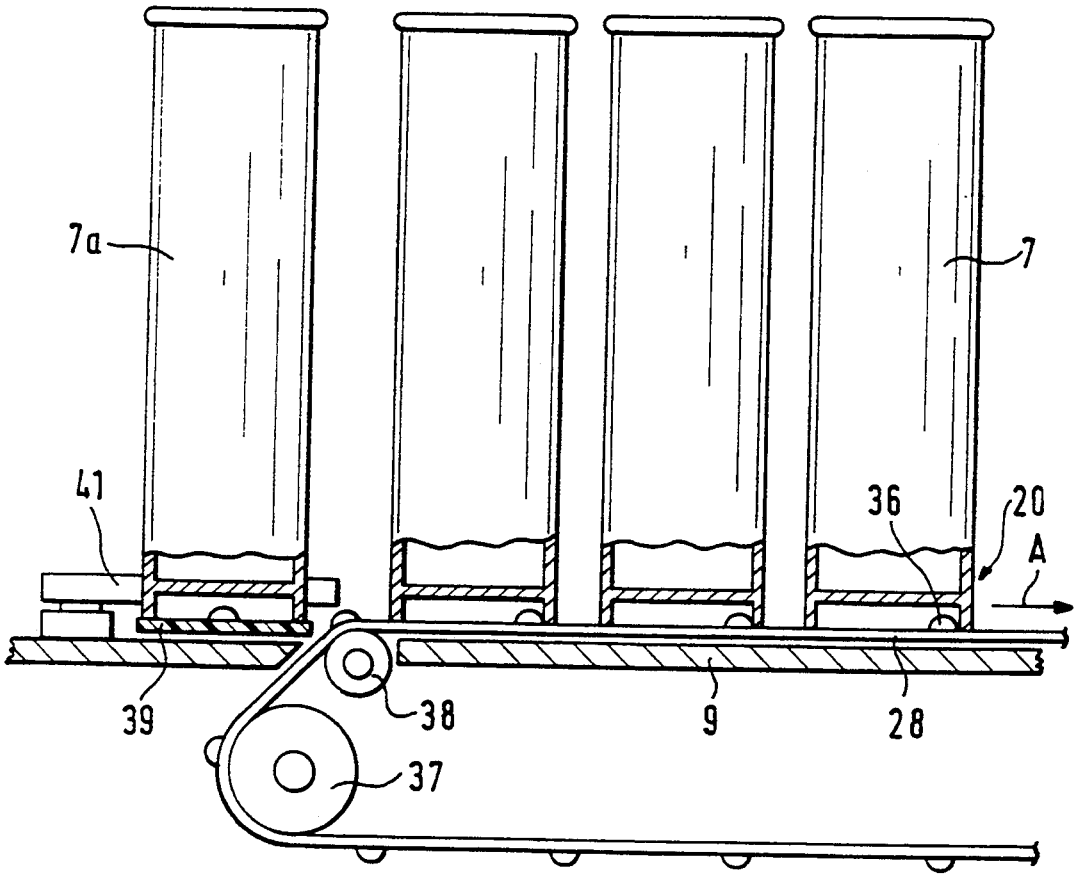
FIG. 2 is a partially sectional view in the direction of the arrow II of FIG. 1.
Figure 3:
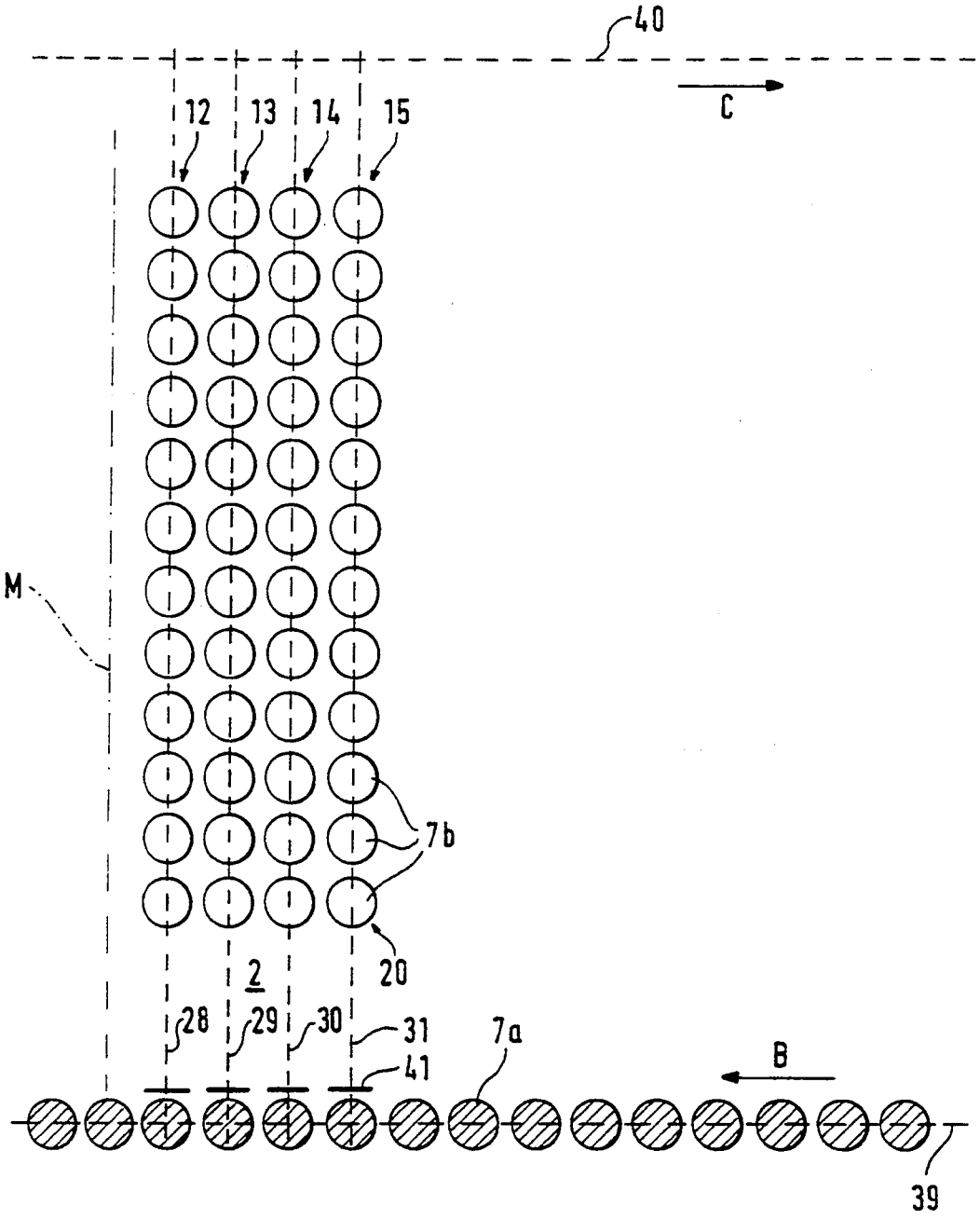
FIG. 3 is a schematic partial top view at a slightly changed scale of the spinning machine system of FIG. 1 in the direction of the arrow III.

The machine system, which is schematically shown in FIGS. 1 to 3, comprises several ring spinning machines 1, of which only one is shown. On both sides of its longitudinal center plane (M) the ring spinning machine 1 is provided with a plurality of spinning stations 4 which in each case are arranged next to one another in the longitudinal direction of the machine. The number of spinning stations 4 of each side of the machine 2, 3 may be above 500. Each of these spinning stations 4 comprises an outlined drafting unit 5 and an outlined ring spindle 6 of the customary construction. The drafting units 5 are constructed as three-cylinder drafting units. Other spinning machines, such as wind-around spinning machines or air spinning machines or the like, may also be provided in an arrangement that is similar in principle.

The spinning stations 4 spin slivers 8 which are fed in cans 7. The slivers 8 preferably have a yarn size of approximately Nm 0.3 to approximately Nm 0.8 so that the necessary drafts of three-cylinder drafting units 5 can be applied.

The diameters of the cans 7 are larger than the division of the spinning stations 4, that is, the distance between two ring spindles 6. The cans 7 are therefore deposited in four rows 12, 13, 14, 15 and 16, 17, 18, 19 respectively for each side 2, 3 of the machine on depositing sites 20 which extend in the longitudinal direction of the machine.

In order to permit a space-saving housing of the cans 7, the depositing sites 20 are situated above the ring spinning machine 1 on a platform 9 which is supported on the floor 11 by means of supports 10. In order to feed the fine slivers 8 without any faulty drafting from the cans 7 to the drafting units 5, guiding devices for the slivers 8 are provided. Guiding belts 21 are used as the guiding devices which are each guided at an angle by means of four reversing rollers 22, 23, 24, 25 in such a manner that a section exists which receives the slivers 8 above the cans 7 and which changes into an essentially vertically extending section which, in each case, is situated in the center of the machine and which leads downward through the platform 9 to the feeding roller pairs of the drafting units 5. One of the reversing rollers, preferably reversing roller 22, is drivable. Sliding skids, which are not shown, are assigned to the downward travelling ends of the guiding belts 21 so that, in the area of the approximately vertical sections, the slivers are guided between the guiding belts 21 and the sliding skids. Regularly spaced masts 26 project upward in the longitudinal center plane (M) from the ring spinning machine, are equipped with cross members 27 and form a supporting frame for the holding of the reversing rollers 22, 23, 24, 25.

The depositing sites 20 for the cans 7 of the rows 12 to 19 are formed by conveyor belts 28 to 35 of belt conveyors which are integrated into the platform 9. As illustrated in FIG. 2 by means of conveyor belt 28, the respective upper end of the conveyor belt 28 (and also of the other conveyor belts) extends on the top side of the platform 9. In the area of the machine end, two reversing rollers 37, 38 respectively are provided of which one, specifically reversing roller 38, is arranged such that it extends approximately tangentially to the top side of the platform 9. The conveyor belt 28 can therefore travel on the top side of the platform 9 or on sliding guides mounted there so that it is also walkable; that is, that an operator can stand on it. As shown in FIG. 2, the conveyor belts, of which conveyor belt 28 is visible, are driven in the direction of the arrow (A). According to the spacing of the depositing sites 20, they are provided with convex, button-type take-along devices 36 which reach behind the lower edges of the cans 7 in which the can bottom is normally set back. As a result, a secure taking-along and a precise positioning of the cans 7 takes place. One of the reversing rollers is provided with a drive which can be switched on and off, preferably the reversing roller which is not visible in FIG. 2 and which is opposite the reversing roller 37 at the other machine end. In a manner not shown in detail, the platform 9, in addition, is advantageously provided with guiding rails which extend in the longitudinal direction of the machine and which have a spacing which is slightly larger than the diameter of the cans 7 so that these cans 7 are also laterally guided. In a modification of the shown embodiment, it may be provided that two adjacent rows 12, 13; 14, 15; 16, 17; 18, 19 of depositing sites 20 respectively are formed by a joint conveyor belt of a belt conveyor; i.e., that the conveyor belts 28, 29; 30, 31; 32, 33; 34, 35 are each constructed as one conveyor belt which then is provided with two rows of button-type take-along devices 36.

During the practical operation of such a machine system, an exchange of cans must be carried out from time to time, that is, an exchange of the cans standing in the rows 12 to 19 for new full cans. This will be necessary when the cans 7 have been spun empty. However, an exchange of cans will also be necessary when a batch change takes place, that is, when a different fiber material is to be spun on the same ring spinning machine 1. Also, if in such a case the cans 7 have not yet been spun empty, they must be exchanged for full cans containing the new fiber material. In the following, also for this case, the cans to be removed are called cans 7 which have been "spun empty".

In order to permit an efficient working, a so-called exchange in blocks is carried out, that is, all cans 7 of a ring spinning machine are exchanged in one working operation, or at least the cans 7 which are assigned to one side of the machine. During the exchange of cans, the spinning operation is interrupted, that is, the ring spinning machine 1 is stopped so that the still entering slivers 8 are not pulled in farther but remain in the area of the guiding belts 21. It will then be possible to connect the respective start of the slivers of the newly fed cans with the still existing sliver residue so that then the ring spinning machine can be switched on again and the spinning operation can be resumed. In order to keep available the sliver ends of the cans that had been spun empty at defined points, corresponding devices 42 are assigned to the guiding devices for the slivers 8 and are activated during the stopping of the ring spinning machine 1. These devices 42 may form sliver clamps and/or devices for cutting the slivers.

In the following description and in FIGS. 3 to 11, the full cans have the reference number 7*a* and, in order to clarify the drawing, are additionally provided with a hatching. The cans which have been spun empty have the number 7*b*. In the following description, it is also assumed that the exchange of cans is carried out semi-automatically, that is, is assisted by one or several operators. However, it is also within the scope of the invention to carry out the can exchange fully automatically. The work of the operator or operators consists mainly of the switching-on and off of drives and of the connecting of the ends of the slivers still situated in the guiding devices of the ring spinning machine 1 with the starting pieces of the slivers of the full cans 7*a*. However, this work may naturally also be carried out by one or several automatic devices.

FIG. 3 shows the condition (for one side 2 of the machine) in which the cans 7*b* are spun empty and the ring spinning machine was switched off in the described manner. The ends of the old slivers 8 are therefore kept ready at defined sites so that they can be connected by the operator or by an automatic device with the starting piece of the slivers of the full cans 7*a* as soon as they have arrived on the depositing sites 20. This connecting may take place, for example, by means of rubbing. After the switching-off of the ring spinning machine 1, the belt conveyors are switched on (FIG. 4) so that the conveyor belts 28 to 31 travel in the direction of the arrows (D, E, F and G) to the machine end and transfer the cans 7*b*, which have been spun empty, to a conveyor belt 40 which travels past transversely to the longitudinal direction of the machine and guides the cans 7*b*, which have been spun empty, in the direction of the arrow (C) to a path, which is not shown, and in which the cans 7*b* are again filled with a new sliver.

Figure 4:
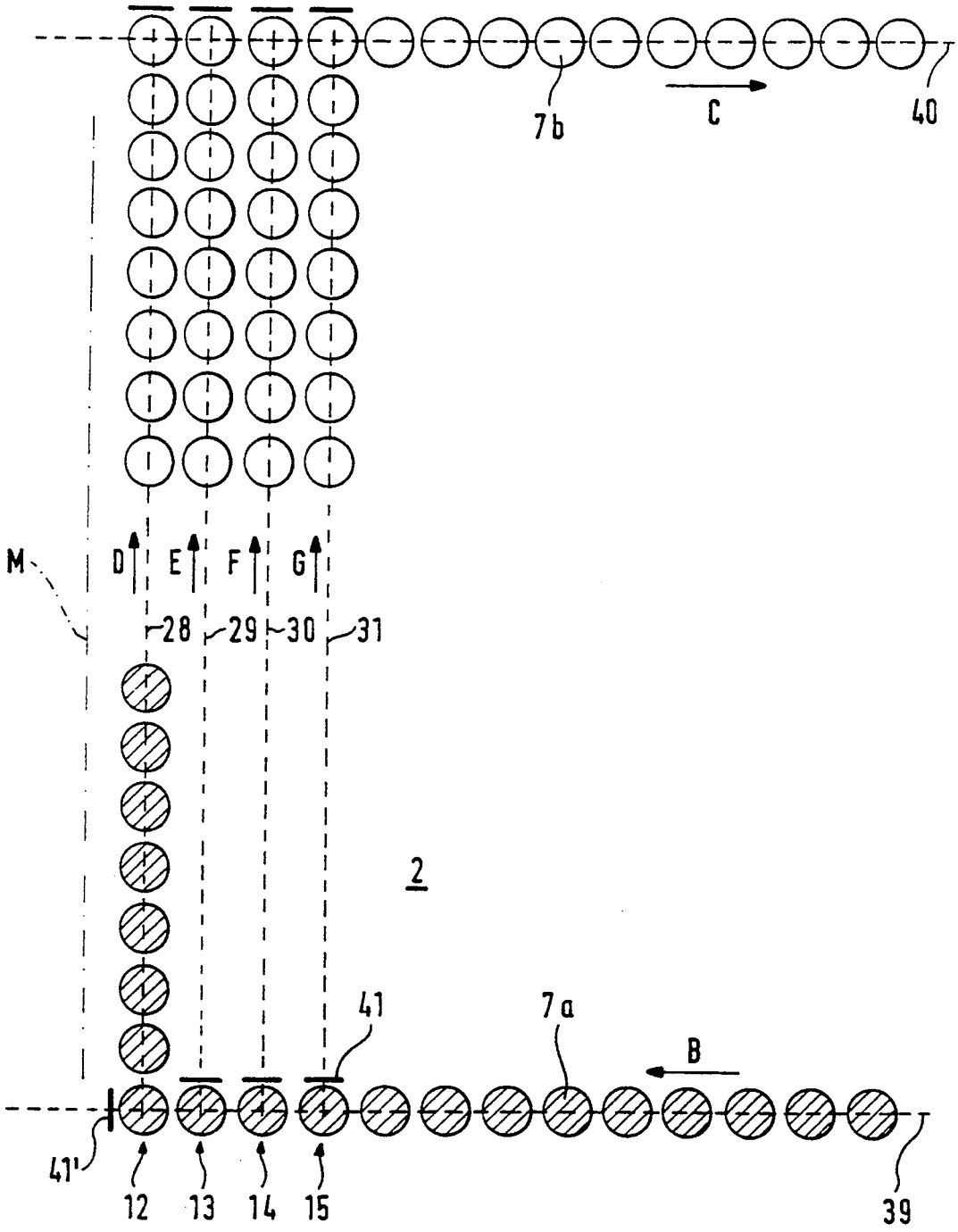
FIGS. 4 to 8 are partial top views similar to FIG. 3 for explaining the exchange of cans spun empty for full cans.
Figure 5:
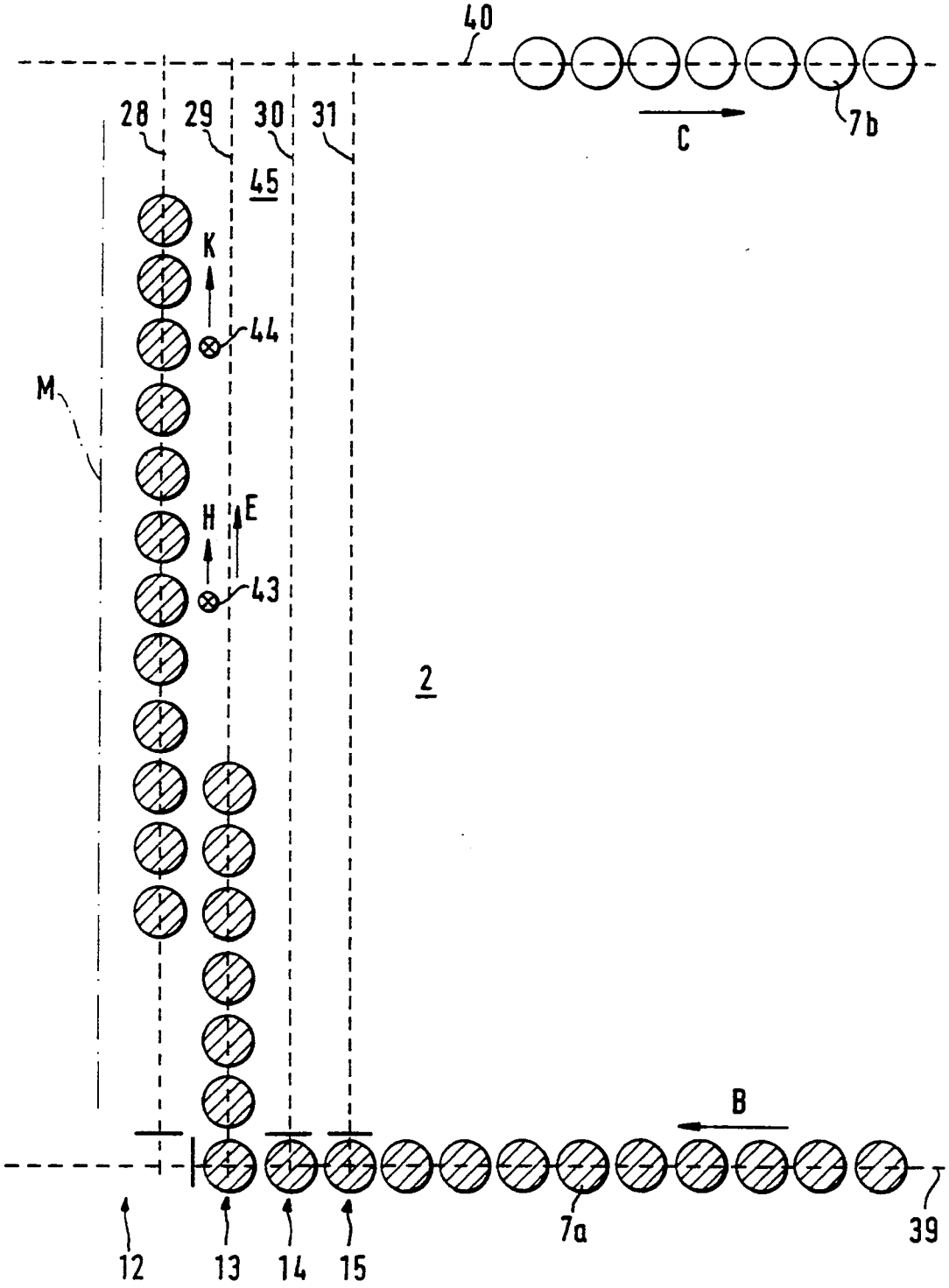
Figure 6:
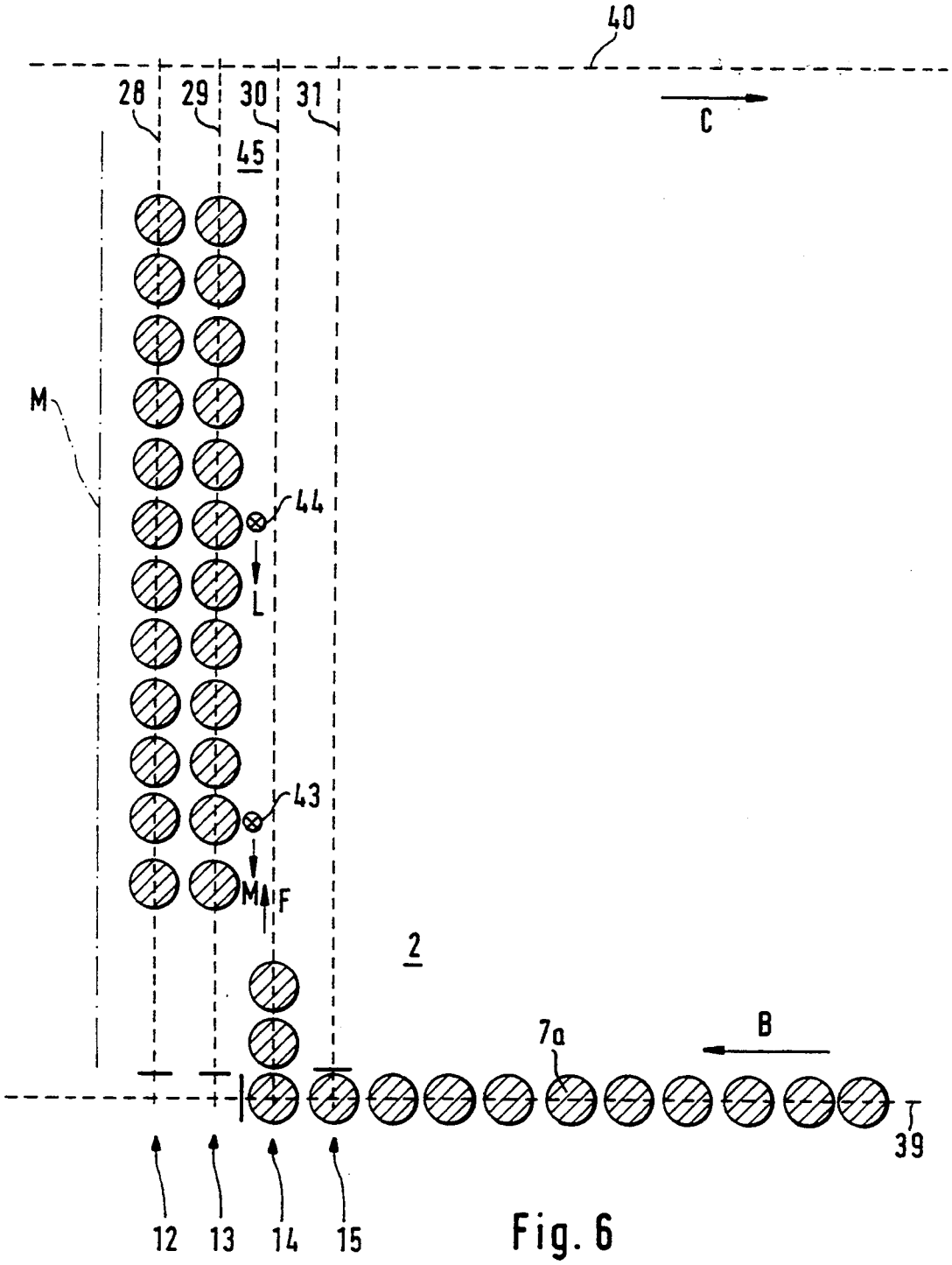
Figure 7:
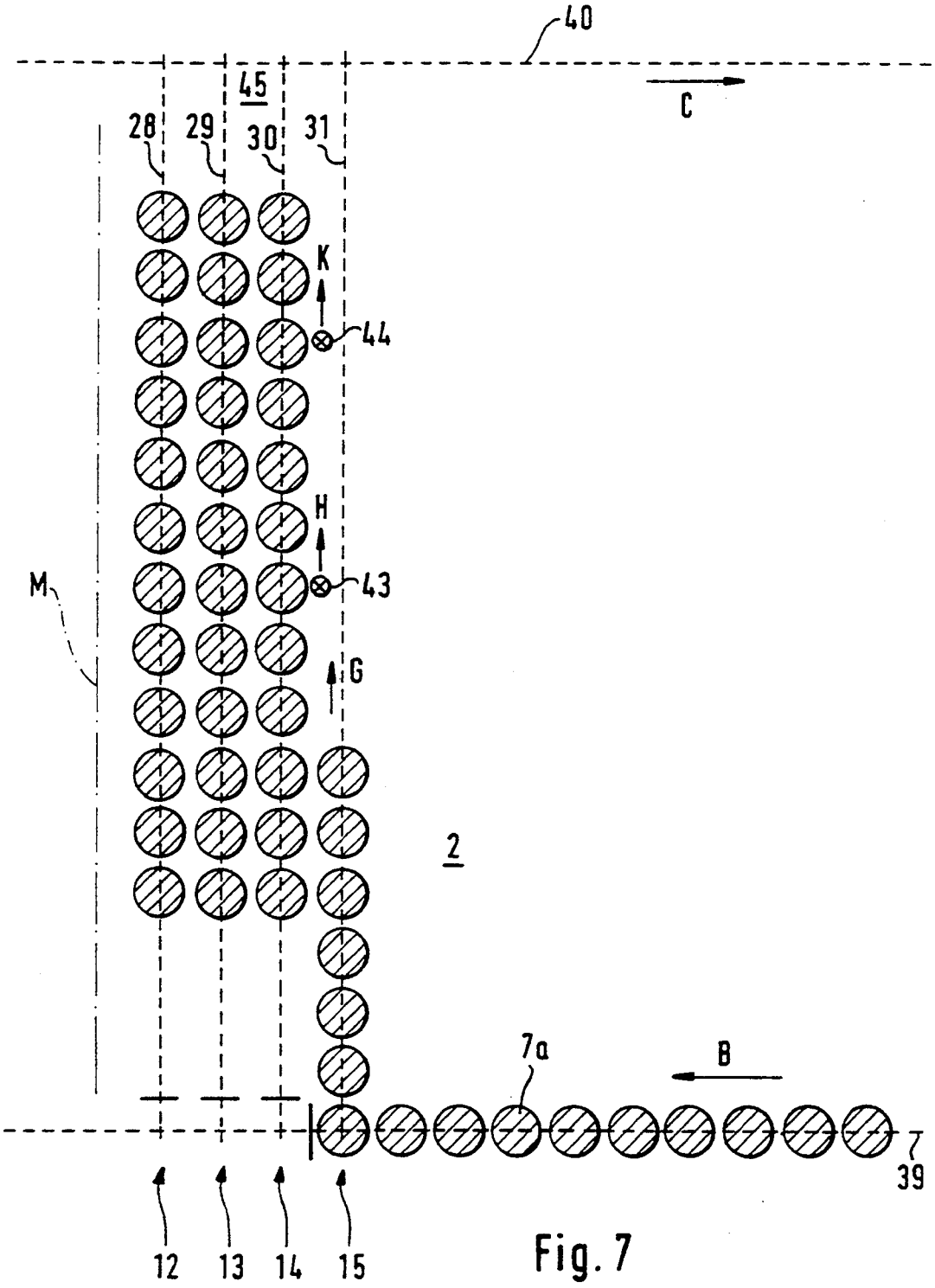
Figure 8:
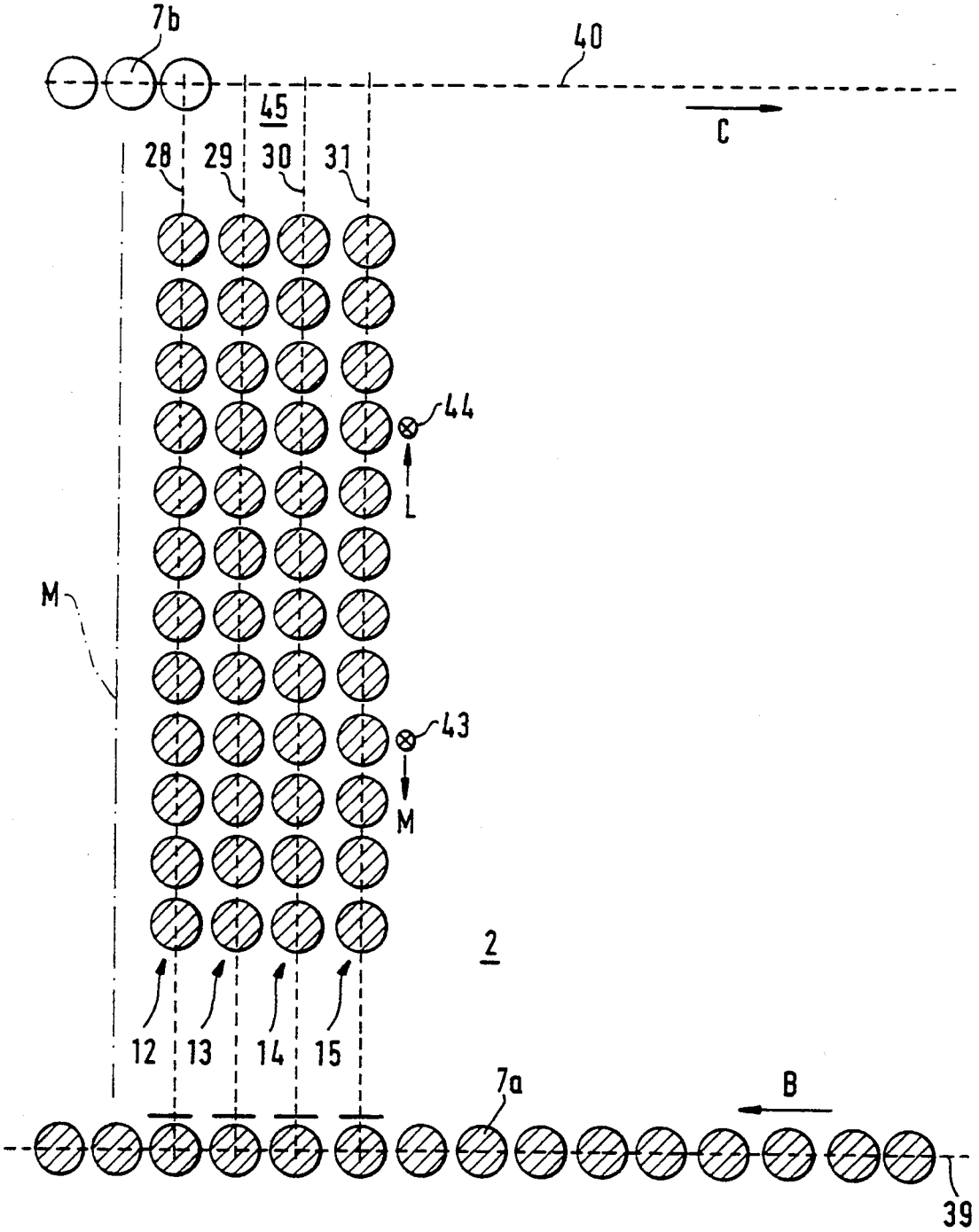

Even during the removing of the cans 7*b*, which were spun empty, the charging of the depositing sites 20 with full cans 7*a* is started. The full cans 7*a* are supplied and made available by means of a conveyor belt 39 travelling in the direction of the arrow (B) which is also shown in FIG. 2. In the inlet area to the conveyor belts 28 to 31, switches 41 are disposed which can be switched in such a manner that, in each case, the inlet to one of the conveyor belts 28 to 31 can be exposed. As shown in FIG. 4, first, only one row 12 is charged with full cans 7*a*, specifically the inner row 12,w which faces the longitudinal center plane (M). After this row 12 has been completely charged with full cans 7*a*, the continued supply of full cans is first interrupted. Two operators or automatic devices, which are outlined at 43 and 44 (FIG. 5), then carry out the preparation of the spinning points for a withdrawal of the new slivers; i.e., they piece the starting piece of the slivers of the full cans 7*a* to the ends of the still existing slivers. In this case, the operators or automatic devices 43, 44 move from the feeding side of the spinning machine in the direction of the arrows (H and K), in which case each of the operators or each automatic device prepares half the spinning stations of the row. It is also contemplated to work only with one operator or one automatic device 43 or 44, but the working time will then be increased. Since the rows 13, 14, 15 situated in front of row 12 are still free of cans 7*a*, the cans 7*a* of row 12 are easily accessible for the corresponding work. It is already during this work that the charging of the second row 13 with full cans 7*a* is begun (FIG. 5). After this row 13 has been charged with the necessary number of full cans 7*a*, the preparation of the spinning stations for the withdrawal of the slivers from the full cans 7*a* is also carried out in this row (FIG. 6). For this purpose, the operators 43, 44 or the automatic devices move in the reversed direction into the direction of the arrows (L and M). After the preparation of the spinning stations which are assigned to this row 13 has been concluded, the charging of the next row 14 is started (FIG. 6). After the charging of this row 14, the preparation of the pertaining spinning stations will then again take place, in which case, the operators or automatic devices 43, 44 again move in the direction of the arrows (H, K) (FIG. 7). Already during this operation, the charging of the fourth row 15 will full cans 7*a* is started (FIG. 7). After the conclusion of this charging, the spinning stations assigned to this row 15 are also prepared, in which case the operators or automatic devices 43, 44 again move into the direction of the arrows (L, M) (FIG. 8). After the conclusion of this preparation, the ring spinning machine 1 can be restarted. Since the cans 7*a* are all filled with at least approximately the same amount of sliver, it is to be expected that these cans 7*a* later will also all almost simultaneously be spun empty so that then an exchange of blocks of cans 7 can again be carried out in an appropriate manner.

In order to charge the individual rows 12, 13, 14, 15, at appropriate time intervals, with full cans 7*a*, the switches 41 can be switched in a computer-controlled manner. In this case, it should be taken into account that, during the preparation of the spinning stations belonging to the second row 13, the operator or the automatic device 43, 44 move in the direction of the feeding side so that the charging of the row 14 which follows can only be started with a time delay, that is, after the conclusion of the preparation of all pertaining spinning stations. However, it is also possible for the operator or the automatic device 43, 44 to each carry out the switching-over of the switches, in which case the respective appropriate points in time will then be selected.

The drives of the belt conveyors with the conveyor belts 28 to 31 are constructed such that, on the one hand, they can be switched on jointly, that is, for the moving-away of the cans 7*b* which were spun empty, but, on the other hand, may also be switched on and off again individually, as expedient for the charging of the individual rows 12, 13, 14 15, row by row.

Figure 9:
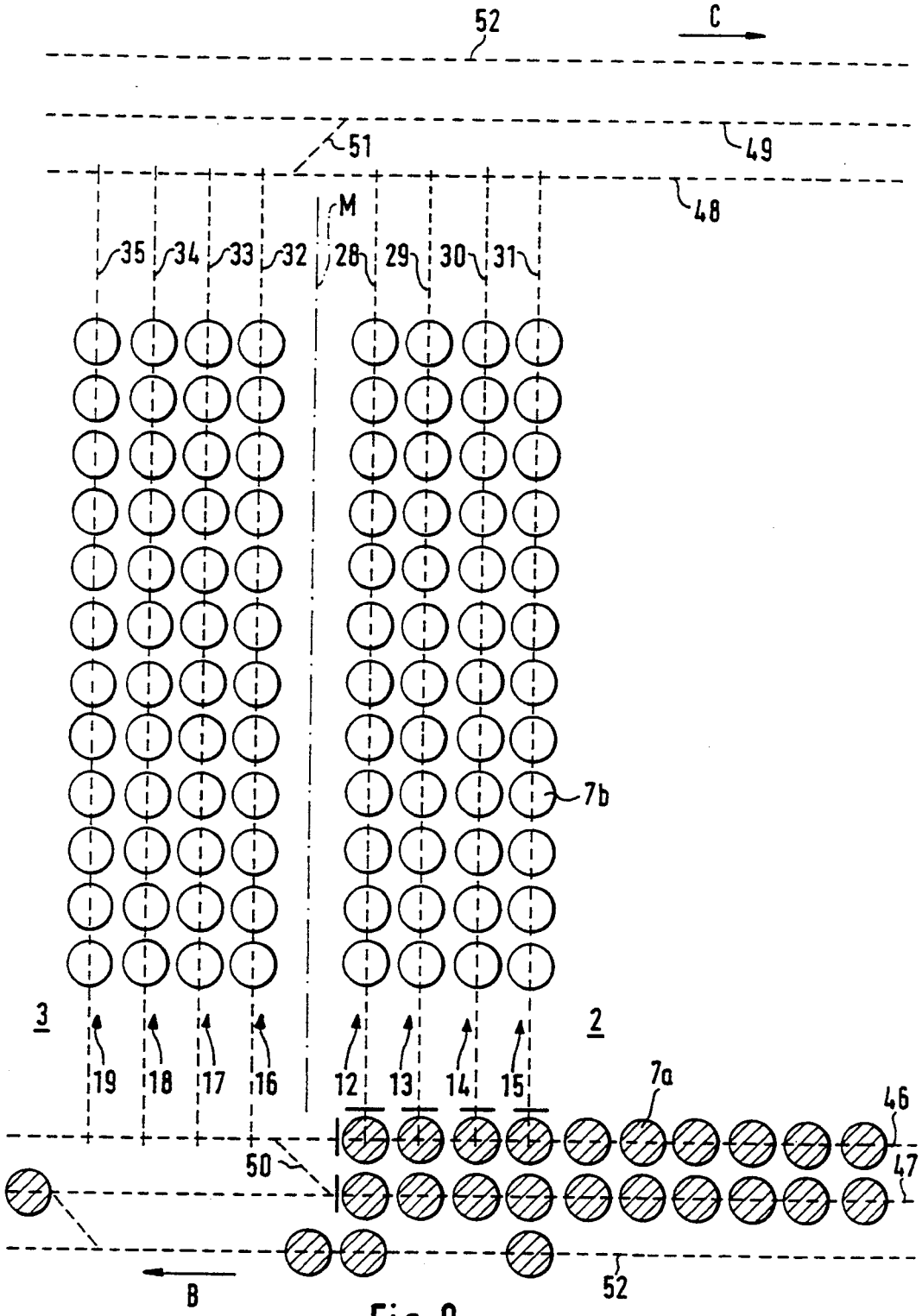
FIGS. 9 to 11 are partial top views similar to FIG. 3 of a machine system where a slightly modified process according to the invention is carried out.
Figure 10:
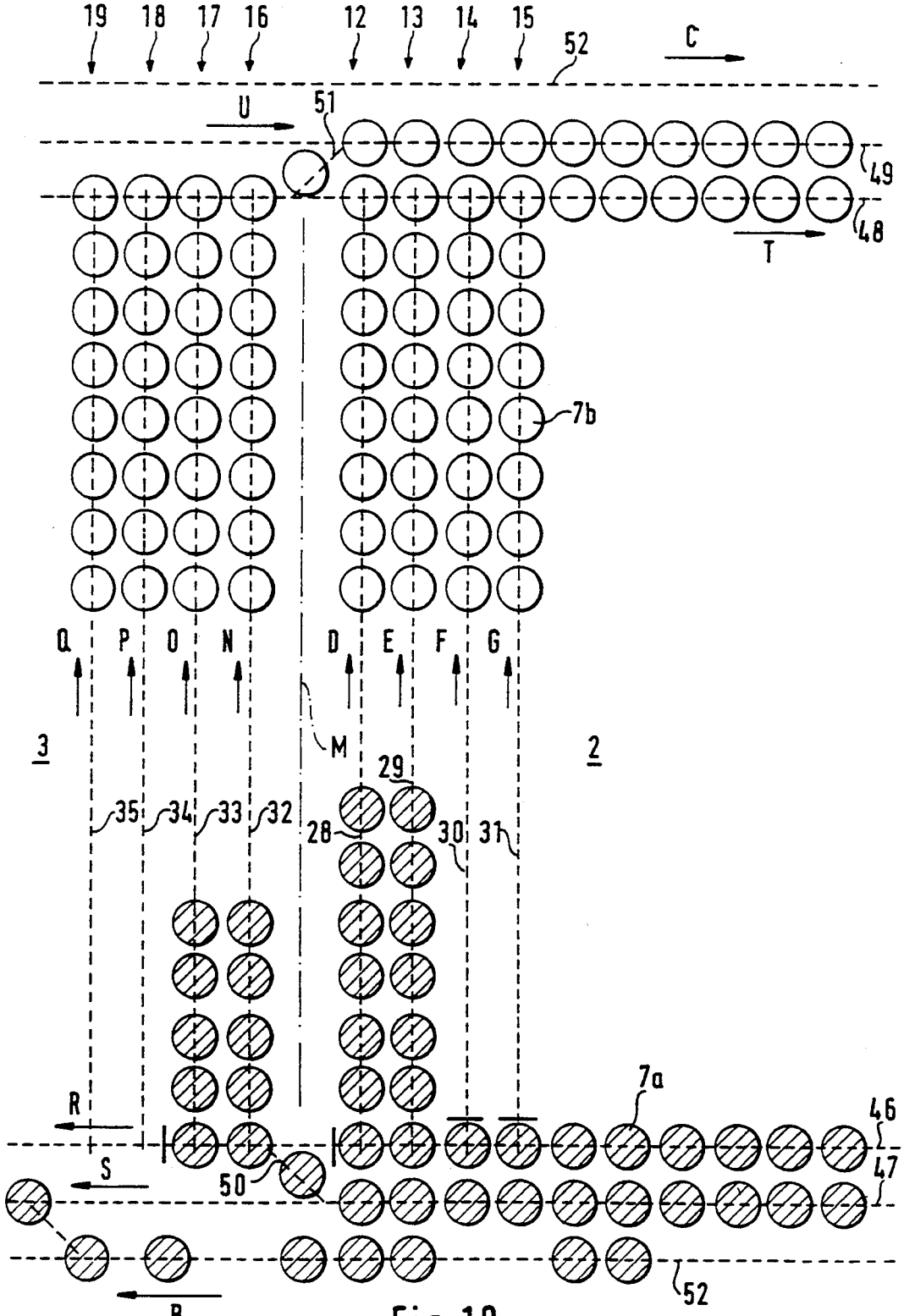
Figure 11:
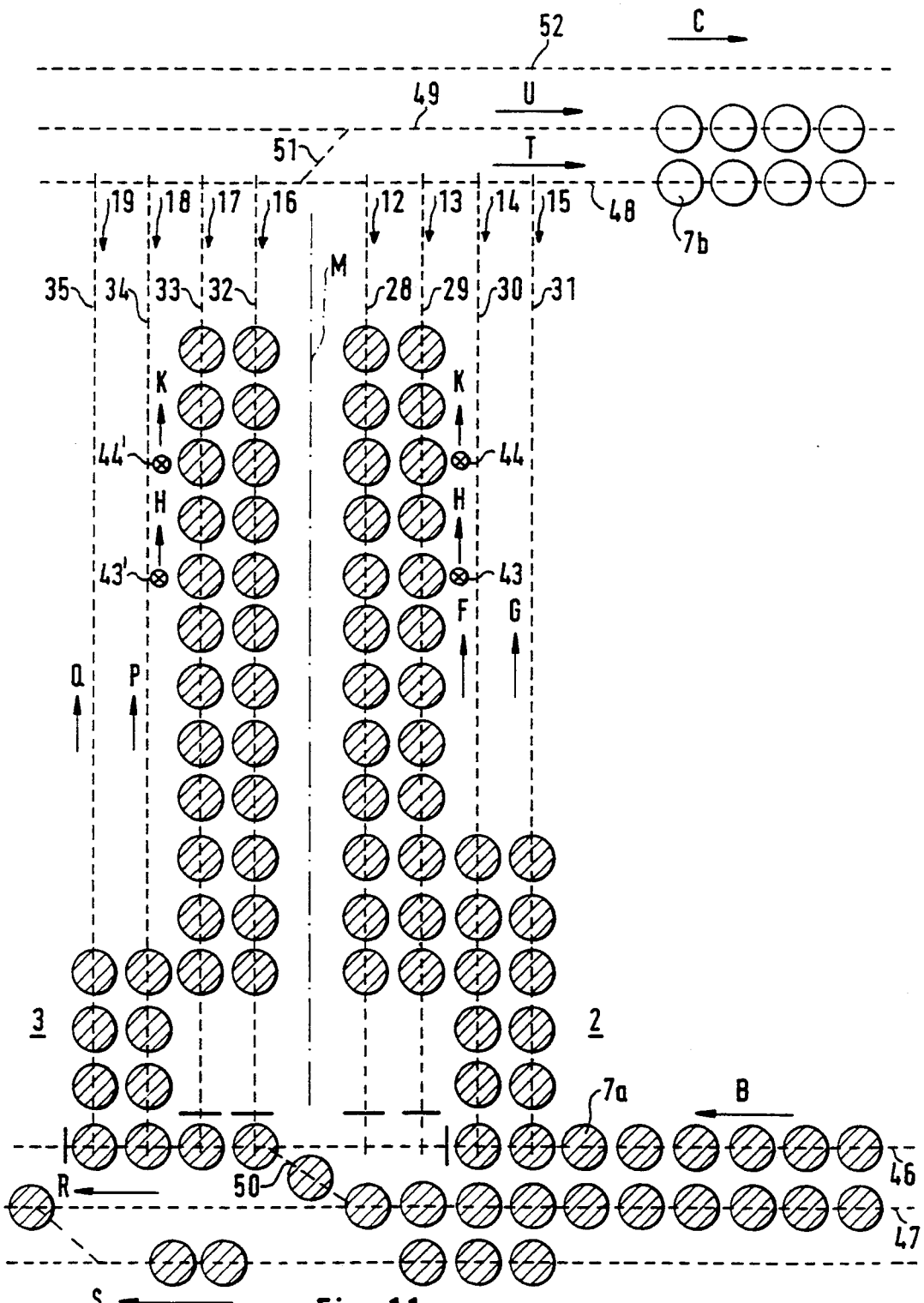

Under the condition that the diameters of the cans 7 permit that an automatic device or an operator 43, 44 can reach over a row 13, 14, 15 and can service the spinning stations belonging to the row 12, 14 situated in front of it by connecting the starting pieces of the new slivers with the ends of the old slivers, the process according to FIGS. 9 to 11 can be modified in such a manner that two rows 12, 13; 14, 15; 16, 17; 18, 19 respectively can be simultaneously charged with full cans 7*a*. In this case, after the determination that the cans 7*b* are spun empty, which preferably was also made automatically, the spinning machine is (automatically) switched off in such a manner that the ends of the old slivers are still situated at defined points (FIG. 9). Subsequently, the cans 7*b*, which were spun empty, are jointly moved away by the switching-on of the belt conveyors with the conveyor belts 28 to 35. Shortly afterwards, the charging of the two rows, 12, 13; 16, 17, which are each adjacent to the machine center, with full cans 7*a* is already started (FIG. 10). After the conclusion of this charging, the preparation of the spinning stations takes place, after which then the respective remaining rows 14, 15; 18, 19 are charged with full cans 7*a* (FIG. 10), after which the spinning stations which pertain to them are then also prepared.

Particularly when the rows 12 to 19 of depositing sites 20 of both sides 2, 3 of the machine are to be serviced simultaneously by means of a can exchange in blocks, it is expedient to provide not only a feeding belt 39, as in the case of the embodiment according to FIGS. 3 to 8, but two parallel extending feeding belts 46, 47 and also two removal belts 48, 49 for the cans *7b* spun empty which extend in parallel to one another. The feeding belt 46, which travels on the inside, in this case, is used for the charging of the rows 12, 13, 14, 15, which are first in the travelling direction (B), while the outer feeding belt 47 is used for the charging of the rows 16, 17, 18, 19 which follows in the transport direction (B). In the area of the machine center, the full cans *7a*, by means of a switch 50, are taken off on the outer feeding belt 47 and are transferred to the inner feeding belt 46 from which the full cans *7a* are then applied to the rows 16 to 19. In a similar manner, a switch 51 is arranged between the removal belts 48, 49 by means of which the cans *7a*, which were spun empty, of the rows 16 to 19, which are disposed in the front in the removal direction (C), are guided to the outer removal belt 49, while the inner removal belt 48 takes over the cans *7b*, which were spun empty, of the rows 12, 13, 14, 15 which follow.

As illustrated in FIGS. 9 to 11, an additional circulating conveyor belt 52 is provided which takes over filled cans *7a* from a drafting frame and then applies them to the individual ring spinning machines 1 at which a can exchange is carried out soon. By means of the circulating conveyor belt 52, the full cans *7a*, by way of switches, are then guided to the feeding belts 46, 47.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for exchanging cans on a spinning machine of the type which is provided with a plurality of spinning stations on at least one side of the machine to each of which spinning stations a depositing site is assigned for a can containing a sliver to be spun, the depositing sites being arranged in several rows extending in a longitudinal direction of the machine, comprising:

stopping the spinning machine before an exchange of the cans;

exchanging all empty cans assigned to the spinning stations of at least one side of the machine for full cans during a common changing operation, said exchanging including:

a) transporting all empty cans so that all depositing sites assigned to said at least one side of the machine are vacant;

b) feeding the full cans in such a manner that at least one row of depositing sites that is closest to the spinning machine is supplied with cans first;

c) preparing the cans of the at least one closest row and the corresponding spinning stations for spinning;

d) supplying at least one next closest row of depositing sites with full cans;

e) preparing said at least one next closest row of cans and the corresponding spinning stations for spinning;

f) repeating steps d) and e) until all rows of depositing sites of said at least one side of the machine are supplied with full cans and all of the spinning stations are prepared; and switching on the spinning machine again.

2. A spinning machine comprising:

a plurality of spinning stations on at least one side of the spinning machine;

transport devices extending in a longitudinal direction from a first end to a second end of the spinning machine, the transport devices including for each spinning station a depositing site for a can containing a sliver to be spun, the depositing sites being arranged in several rows extending in the longitudinal direction of the machine, said rows being arranged on the same side of the spinning machine as the pertaining spinning stations;

supplying devices coupled to the transport devices, the supplying devices supplying full cans at the first end of the spinning machine; and removal devices coupled to the transport devices, the removal devices removing empty cans at the second end of the spinning machine;

wherein the transport devices are conveyor belts extending in a longitudinal direction of the machine for simultaneously transporting the cans of a pertaining row.

3. A process according to claim 1, wherein the step of transporting all empty cans includes removing the empty cans on one end of the spinning machine, the step of feeding the full cans includes feeding the full cans at another end of the spinning machine, and the steps of transporting and feeding including transporting the cans along the rows of depositing sites.

4. A process according to claim 1, wherein the feeding of full cans and the preparing of the spinning stations for spinning is performed in a direction that is along the rows of the depositing sites.

5. A process according to claim 1, wherein at least two closest rows of depositing sites are simultaneously supplied with cans and are prepared with spinning stations at the same time.

6. A process according to claim 3, wherein the feeding of full cans and the preparing of the spinning stations for spinning is performed in a direction that is along the rows of the depositing sites.

7. A process according to claim 3, wherein at least two closest rows of depositing sites are simultaneously supplied with cans and are prepared with spinning stations at the same time.

8. A process according to claim 4, wherein at least two closest rows of depositing sites are simultaneously supplied with cans and are prepared with spinning stations at the same time.

9. A spinning machine according to claim 2, wherein the conveyor belts of the belt conveyors are provided with elements which are engageable with the bottom of a can.

10. A spinning machine according to claim 2, further comprising a separate conveyor belt for each row of depositing sites.

11. A spinning machine according to claim 2, further comprising a common conveyor belt for two adjacent rows of depositing sites respectively.

12. A spinning machine according to claim 9, further comprising a walkable platform arranged above the spinning machine, the platform forming a housing for the conveyor belt.

13. A spinning machine according to claim 2, further comprising guiding devices for the slivers above the depositing sites, the guiding devices guiding the slivers to the spinning stations.

14. A spinning machine according to claim 13, wherein devices for the fixing of an end of the slivers travelling to the spinning stations are assigned to the guiding devices.

15. A spinning machine according to claim 11, further comprising guiding devices for the slivers above the depositing sites, the guiding devices guiding the slivers to the spinning stations.

16. A spinning machine according to claim 12, further comprising guiding devices for the slivers above the depositing sites, the guiding devices guiding the slivers to the spinning stations.

* * * * *